United States Patent [19]

Schäfer

[11] Patent Number: 4,703,980

[45] Date of Patent: Nov. 3, 1987

[54] TRANSPORT CONTAINER FOR STACKED GOODS WITH SKIDS

[75] Inventor: Gerhard Schäfer, Neunkirchen-Salchendorf, Fed. Rep. of Germany

[73] Assignee: Fritz Schäfer Gesellschaft mit beschränkter Haftung, Neunkirchen, Fed. Rep. of Germany

[21] Appl. No.: 802,752

[22] Filed: Nov. 27, 1985

[30] Foreign Application Priority Data

Nov. 27, 1984 [DE] Fed. Rep. of Germany ... 8434693[U]

[51] Int. Cl.[4] ..... A47B 87/02

[52] U.S. Cl. ..... 312/111; 312/253; 312/323

[58] Field of Search ..... 312/323, 253, 257 SK, 312/102, 111, 109, 308, 323; 211/194, 187, 186

[56] References Cited

U.S. PATENT DOCUMENTS

| | | | |
|---|---|---|---|
| 352,828 | 11/1896 | Lee | 312/323 |
| 2,719,772 | 10/1955 | Petkwitz | 312/308 X |
| 3,559,812 | 2/1971 | Wolf | 211/194 |
| 3,736,035 | 5/1973 | Brown et al. | 312/257 SK |
| 3,794,401 | 2/1974 | Dean et al. | 312/323 |
| 3,892,189 | 7/1975 | Killam | 211/186 X |
| 4,359,250 | 11/1982 | Jenkins | 312/253 |
| 4,415,077 | 11/1983 | Murphy | 211/194 |

*Primary Examiner*—Joseph Falk

*Attorney, Agent, or Firm*—Toren, McGeady & Associates

[57] ABSTRACT

A transport container 1 for stacked goods consists of a base plate 2 with skids 3 welded underneath. In addition, it has four upright corner posts 4 between which are fitted in side walls 5. However, it also has an upper frame 6 with stack corners 7 above the corner posts 4, the stack corners 7 being directed upward. The transport container 1 for stacked goods is constructed in such a way as to be suitable for receiving small quantities of various bulk goods or parts and to ensure access to the various bulk goods or parts, respectively, at any time, as desired. Therefore, four upright rails, which are provided with a row of slots 16*a,* are arranged in the interior of the container at or in the vicinity of the corner posts, at which rails storage tubs 13 or shelving floors 14 can be directly suspended by means of girders 15. One of the side walls 5 is provided so as to be displaceable, preferably vertically swivelable as a closing flap 9, relative to the two corner posts 4 adjacent to it and relative to the base plate and to the upper frame 6 for the purpose of releasing and closing an opening 12.

9 Claims, 7 Drawing Figures

Figure 1:
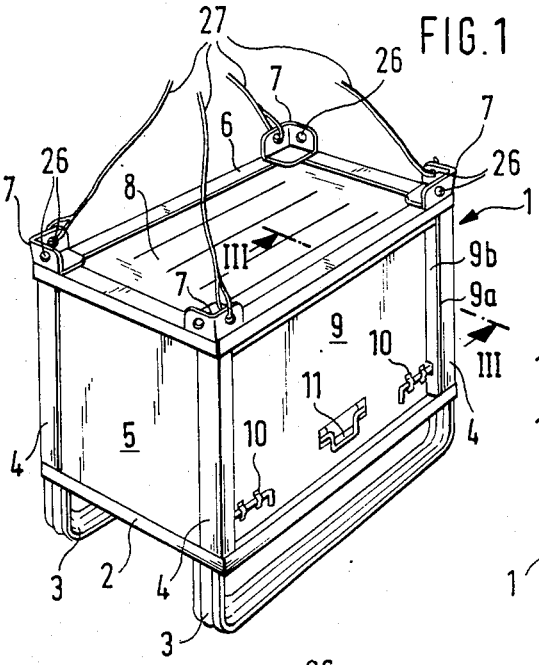

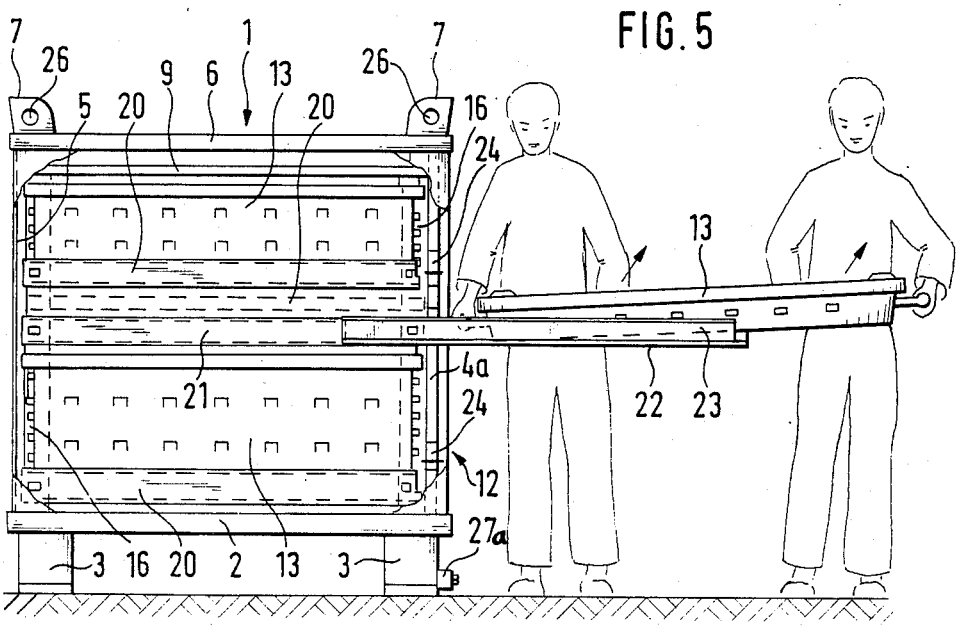
FIG. 5
FIG. 7
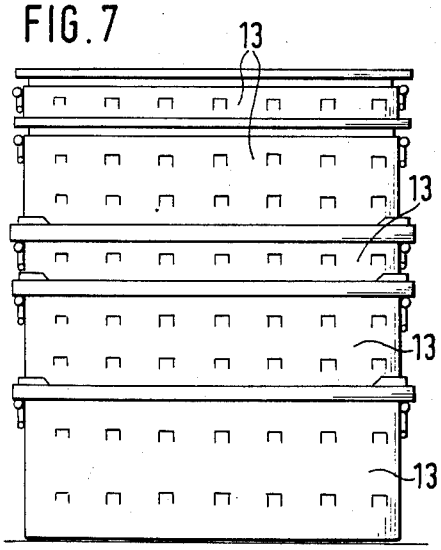
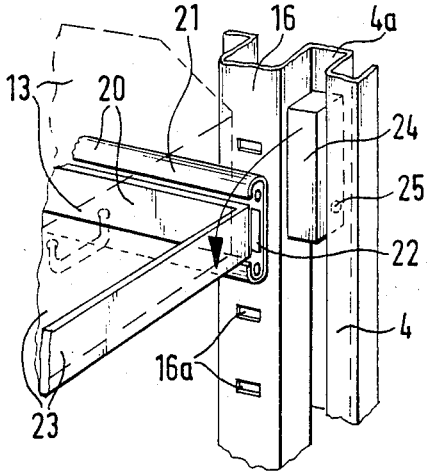
FIG. 6

TRANSPORT CONTAINER FOR STACKED GOODS WITH SKIDS

The invention is directed to a transport container for stacked goods with skids, consisting of a base plate with skids, which are preferably welded underneath in the longitudinal direction, corner posts, between which side walls are fitted in, and an upper frame with upwardly directed stack corners above the corner posts.

Transport containes of this type for stacked goods are constructed so as to be open at the top and serve chiefly for the storage and transportation of bulk goods of all types.

The known transport containers for stacked goods are designed so as to have a relatively large volume and are therefore not particularly well-suited for receiving bulk goods or parts, respectively, which are not needed in great mass in a place of use, but, rather, in relatively small quantities. Specifically, bulk goods of especially high quality and valuable parts, respectively, are generally kept available only in relatively small quantities, for example, in order to avoid undesirable loss.

It is possible, of course, to use smaller containers for receiving smaller quantities of bulk goods and parts, respectively. However, this results in the disadvantage that the number of movement sequences during the transfer of the containers by means of a crane or fork lift, or the like, are correspondingly multiplied.

The latter disadvantage can, of course, be avoided in that a larger quantity of relatively small transport and storage containers are placed in the aforementioned large-volume transport containers for stacked goods from above one on top of the other. But such a step has the disadvantage, in turn, that desired access to one of the containers which are placed one on top of the other is only possible if the respective container arranged above it is lifted out beforehand.

The invention has the object of providing a transport container for stacked goods of the type specified in the beginning which is suitable also for receiving smaller quantities of different bulk goods or parts for common transport and common storage, but which also ensures that easy access to the various goods received in the transport container for stacked goods is possible at any time, as desired.

This object is met, according to the invention, in that upright rails, which are provided with a row of slots, are arranged in the container interior at or in the vicinity of the corner posts, at which rails storage means such as, e.g. storage tubs or, also, shelving floors, can be directly suspended by means of girders; and in that one of the side walls is provided so as to be displaceable, preferably in a vertically swivelable manner as a closing flap, relative to the two corner posts adjoining it, relative to the base plate and to the upper frame for the purpose of opening and closing an opening.

Such a transport container for stacked goods can also possibly be used in the work position of the side wall, which is, for example, constructed as a closing flap, for receiving large quantities of bulk goods or parts if the latter are accessible from the opening which is defined by the upper frame.

However, should the transport container for stacked goods not be usable for receiving a large quantity of bulk goods or parts, then it is recommended that the upper frame be securely closed by means of a cover plate fitted into it.

It has proven particularly advantageous, according to the invention, when the side wall, which is constructed as a vertically swivelable closing flap, is held beneath the upper frame or the cover plate so as to be able to slide into the container by means of guide beads or guide rollers.

It is provided in addition that the storage means, e.g. storage tubs or shelving floors, be held at the rails so as to be set back in the container interior relative to the corner posts defining the opening and the side wall forming the closing flap is received between the corner posts in its closed position.

It is provided in addition, according to the invention, that the closing flap is defined by outwardly beveled borders and at the outside of the latter are arranged bars and drop handles lying within the vertical distance of the border area.

But it has also proven successful, according to the invention, when the rails comprising the rows of slots are constructd so as to form a constructional unit with the corner posts, e.g. when they are formed with the latter by bevel sections, wherein the rails simultaneously form receiving sections, which are directed toward the outside, for holding the side walls, and the storage means are suspended at the rails either directly or with the intermediary of support guides. The support guides can be formed by telescopic extensions having a retaining section, which is insertable in the slot rows of the rails so as to be stationary, and a carrying element for the storage means, which carrying element is displaceable in a longitudinal direction relative to the retaining section, wherein the carrying element can be secured at the telescopic extensions against displacement relative to the retaining section in the position of insertion in the container interior, wherein, in addition, the carrying element of the telescopic extensions is constructed as a sectional frame, which is open at the top, or as a flat trough and at least one storage tub is placeable in one of the former as storage means.

Securement against displacement can be formed by swivel brackets which are suspended at the corner posts, e.g. in a molded section groove of the latter, so as to be movable relative to the telescope extensions between a release position and a locking position.

Finally, it is also suggested according to the invention, that the stack corners at the upper frame comprise, in each instance, an opening in its upright side as an engagement for the coupling members of a loading gear or the like. Additionally displaceable pins, bars, or the like can be provided at the skids and are insertable in the openings of the stack corners of the transport container for stacked goods which is located beneath it in the container stack and are lockable in the inserted position.

Figure 3:
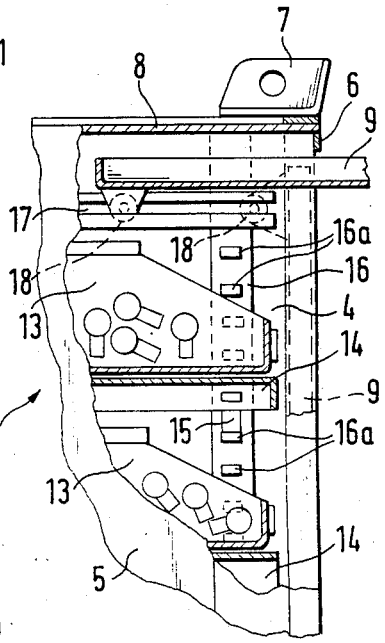
Figure 2:
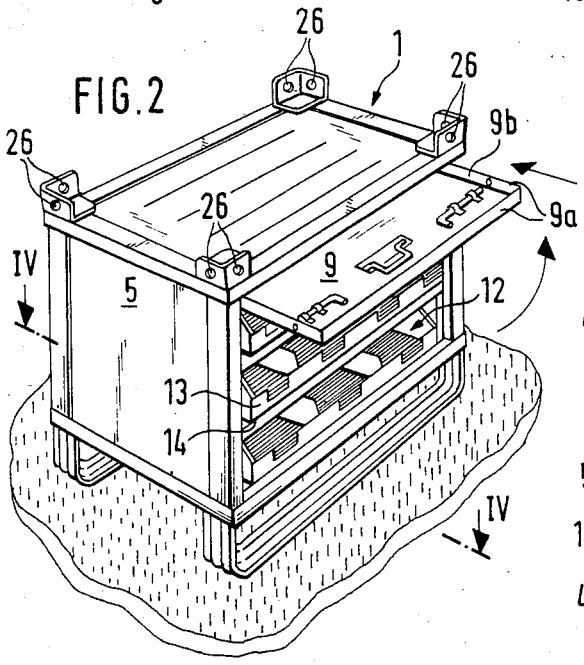
Figure 4:
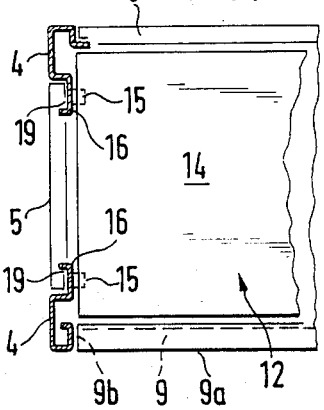

The subject matter of the invention is shown in embodiment examples in the drawing. Shown are:

FIG. 1 A transport container for stacked goods, in the closed state, as seen obliquely from above in a drawing in perspective, FIG. 2 the transport container for stacked goods, according to FIG. 1, likewise in a perspective view as seen obliquely from above, but in the opened state, FIG. 3 a partial section through a transport container for stacked goods in the area of line III—III in FIG. 1, in enlarged scale, FIG. 4 a section along line IV—IV in FIG. 2, FIG. 5 a transport container for stacked goods in a side view and partial section, FIG. 6 a particularly advantageous embodiment possibility for a transport container for stacked goods in a perspective view, and FIG. 7 a side view of various transport and storage containers which can be stacked upon one another, as usable in a transport container for stacked goods according to FIGS. 1 to 5.

The transport container 1 for stacked goods, shown in the drawing, comprises a base plate 2 beneath which are two skids 3, preferably arranged or welded, for example, so as to extend in the longitudinal direction. Four corner posts 4, whose free ends are connected with an upper frame 6, project upward from the base plate 2. A side wall 5 is fitted in, in each instance, between two corner posts 4, the base plate 2 and a crossbeam of the upper frame 6, wherin three such side walls are firmly built in.

The upper frame 6 is provided with stack corners 7 in the area of every corner, that is, above the corner posts 4. The area within the upper frame, which area is open per se, can be securely closed if necessary by means of a fitted in cover plate 8. A displaceable side wall, instead of a fixed side wall 5, is provided, and constructed, for example, as a closing flap 9, between two posts 4 which are assigned, for example, to a longitudinal side of the transport container 1 for stacked goods.

By means of bars 10, particularly slide bars, the closed flap 9 can be fastened in the closing position between the two corner posts 4 adjoining it, the base plate 2 and a crossbeam of the upper frame 6, as can be seen in FIG. 1. An opening 12 of the transport container 1 for stacked goods on the longitudinal side is closed by means of this.

After disengaging the bars 10 the closing flap 9 can be swiveled up out of the closed position according to FIG. 1 into the opening position according to FIG. 2 by means of a drop handle 11. The bars 10, as well as the drop handle 11, are arranged at the closing flap 9 in such a way that they are set back behind the plane of the border edges 9*a* which are formed by outwardly beveled borders 9*b* of the closing flap 9.

As can be seen from FIG. 2, the opening 12 of the transport container 1 for stacked goods on the longitudinal side can be made freely accessible by means of swiveling up the closing flap 9. Arranged behind this opening 12 in the interior of the transport container 1 for stacked goods in several tiers one above the other are storage tubs 13 which preferably rest on shelving floors 14.

However, suitable arrangements also make it possible, if necessary, to install the individual storage tubs 13 directly in the transport container 1 for stacked goods.

As follows from FIG. 3, upright rails 16, each of which is provided with a row of slots 16*a*, are arranged in the container interior at or in the vicinity of the corner posts 4 and the individual shelving floors 14 can be installed at the rails 16 by means of girders 15 so as to be vertically adjustable.

But, as already mentioned, the girders 15 can also be constructed in such a way that they directly support and carry, respectively, the storage tubs 13 within the transport container 1 for stacked goods.

As can be seen particularly clearly from FIG. 4, it is advantageous to construct the rails, which are provided with the row of slots 16*a*, so that in each instance it forms a constructional unit with a corner post 4, wherein it is advantageous if the corner posts 4 with the rails 16 are formed by bevel sections.

The rails 16 can form receiving sections 19 for holding the side walls 5, which receiving sections 19 are directed toward the outside of the transport container 1 for stacked goods.

Arranged beneath the upper frame 6 or the cover plate 8 fitted into the latter are guide beads 17 which receive rollers 18 by means of which the closing flap 9 is displaceably guided into the transport container 1 for stacked goods horizontally in the area of its upper end, as can be seen from FIGS. 2 and 3. The interior of the container is accessible in its entire height and width by means of the opening 12 on the longitudinal side when the closing flap 9 is in the swiveled up position and, simultaneously, in the moved in position into the interior of the transport container 1 for stacked goods.

It can be seen from FIGS. 2, 3 and 4 that the shelving floors 14, as well as the storage tubs 13, occupy a position which is set back relative to the corner posts defining the opening 12. It is possible by these means that the closing flap 9 can be received in its closing position completely between the two corner posts 4, the longitudinal border of the base plate 2 connecting the latter and the crossbeam of the upper frame 6 parallel to the latter, as can be seen from FIGS. 1 and 4

It is indicated in FIG. 5 that telescopic extensions 20 can be inserted in the interior of the transport container 1 for stacked goods at the rails 16, which are provided in the rows of slots 16*a*, as support guides for the storage tubs 13 or also the shelving floors 14, each of which telescopic extension 20 is formed from a stationary retaining section 21 and a carrying element 22 which is longitudinally displaceable relative to the latter. The carrying element 22 can form a section frame, which is open at the top, or a flat trough 23, as indicated in FIG. 6 of the drawing. The storage tubs 13 can then simply be placed, in each instance, from above into this section frame or the flat trough 23. As is made clear by FIG. 5, the individual storage tubs 13 in the telescope extensions 20 can be guided out of the transport container 1 for stacked goods to a considerable degree through the side opening 12 by means of the carrying element 22 and section frame or trough 23, respectively. The storage tubs 13 or the like can then be handled easily and without difficulty when the telescopic extensions 20 are moved out.

In order to secure the carrying element 22 of the telescopic extensions 20 against undesired displacement relative to their retaining section 21 in the inserted position in the interior of the container, swivel brackets 24 are suspended at the corner posts 4, preferably within a section groove 4*a* molded in the latter, so as to be movable around an axle 25 over an angle of approximately 90 degrees between a release position and a locking position. The release position of a swivel bracket 24 can be seen from FIG. 6. The locking position of this swivel bracket 24, on the other hand, is indicated by the tip of the curved arrow drawn in FIG. 6. While the swivel bracket 24 lies completely within the section groove 4*a* of the corner posts 4 in the release position, it is placed horizontally in front of the front end of the carrying element 22 of the telescope guide 20 or in front of the trough 23, respectively, in its locking position. The telescopic extensions 20 and accordingly also the storage tubs 13 supported by their carrying element 22 or troughs 23 are in this way fixed in position within the transport container 1 for stacked goods.

It is indicated, in addition, in FIG. 7 that storage tubs 13 of different constructional heights can be used within the transport container 1 for stacked goods and that these storage tubs 13 are constructed in such a way that they can also be stacked directly upon one another outside the transport container 1 for stacked goods.

Finally, it is noted that the stack corners 7 at the upper frame 6 can have an opening 26, in each instance, preferably in each of their upright sides, which opening 26 is usable as an engagement for the coupling members of a loading gear 27. Pins 27*a* (FIG. 5), which are attached at the skids 3 so as to be axially displaceable, are insertable in the openings 26. The pins 27*a* are first located in a retracted position. After a transport container for stacked goods is placed upon another transport container for stacked goods and the skids 3 of the upper container are received by the stack corners 7 of the lower container, the pins 27 are axially displaced. The front pin ends project into the openings 26. In this position the pins are lockable so that the upper container is secured on the lower container. This is particularly important during the transportation of stacked containers on motor trucks. When the upper container is lifted by means of a crane the lower container is transported also.

I claim:

1. Stackable transport containers for different stacked goods, each container comprising a generally horizontally arranged base plate (2) having an upwardly facing surface and a downwardly facing surface, said base plate having a pair of longer sides and a pair of shorter sides extending transversely of said longer sides, skids (3) secured to and projecting downwardly from said downwardly facing surface of said base plate (2), upright corner posts (4) extending upwardly from the upwardly facing surface of said base plate at the intersection of said longer sides and shorter sides, upwardly extending side walls (5) extending between said corner posts, said side walls (5) having an inside surface forming the upwardly extending inside surface of said container and an outside surface forming the outside surface of said container, a generally horizontally arranged upper frame supported on the upper ends of said corner posts (4) and stacked corners (7) secured to and extending upwardly from said upper frame aligned generally above said corner posts, wherein the improvement comprises upright rails (16) each having a row of vertically spaced slots (16*a*) therein and positioned within said container adjacent to each of said corner posts and adjacent to each of one of said pair of longer and shorter sides, support means adjustably secured in said slots for vertical movement with respect to said side walls, said support means extending transversely of said upright rails, storage means for separately storing different goods removably supported on said support means, and one of said side walls located along one of the other of said pair of longer and shorter sides is displaceably mounted in said container for pivotal movement from a vertically arranged closed position extending in the horizontal direction between a pair of said corner posts and in the vertical direction between said base plate and said upper frame for closing one side of said container and to a horizontally arranged open position uncovering an opening to the interior of said container, said upper frame defines a horizontal opening, a cover plate (8) fitted within the horizontal opening and forming a closure therefor, and said upright rails and support means are inset within said transport container from the pivotally mounted one of said side walls, said pivotally displaceable side wall is a vertically pivotal closing flap (9), means within said container adjacent said upper frame for guiding said closing flap (9) into the open position, said means for guiding said closing flap comprises horizontally extending guides supported on said upright rails (16) and guide rollers (18) secured to said closing flap (9) and slidably movable within said guides for inserting said closing flap into the interior of said container closely adjacent to and below said upper frame, means for interconnecting said transport containers one mounted on the other comprising means for allowing insertion of said skids into the stacked corners of a subjacent container, openings in an upwardly extending part of the said stacked corners, and means located within said skids and removably engageable within the openings in said stacked corners for allowing said containers to be mounted one on the other so the stacked containers can be lifted as a unit.

2. Transport container for stacked goods, as set forth in claim 1, wherein said closing flap (9) is defined by border members (9*b*) bevelled outwardly, bars 10 mounted on the outside surface of said closing flap (9) and arranged to be displaced into locking engagement with said corner posts forming the upwardly extending sides of the opening closed by said closing said flap, and a drop handle (11) secured to the outside surface of said closing flap.

3. Transport container for stacked goods, as set forth in claim 1, wherein each said upright rail 16, is formed as a unit with the adjacent said corner post (4) with bevel sections interconnecting said side rail and said corner post, said rails (16) form recessed receiving sections facing toward the outside surface of said container and said recesses in adjacent said rails arranged for supporting one said side wall therebetween, and said support means incorporated in said storage means for directly suspending said storage means in said slots in said rails.

4. Transport container for stacked goods, as set forth in claim 1, wherein each said upright rail 16, is formed as a unit with the adjacent said corner post (4) with bevel sections interconnecting said side rail and said corner post, said rails (16) form recessed receiving sections facing toward the outside surface of said container and said recesses in said rails arranged adjacent one of said longer and shorter sides for supporting one said side wall therebetween, and said support means comprises horizontally arranged support guides (20) supported in said rails and said storage means slidably mounted in said support guides.

5. Transport container for stacked goods, as set forth in claim 4, wherein said support guides (20) are formed as telescopic extensions including a horizontally arranged retaining section secured on said rails, said retaining section being secured within said slots in said rails in a stationary position, and a movable carrying element (22) for supporting said storage means being horizontally displaceably mounted within said retaining section, means for retaining said carrying element (22) within said retaining section (21).

6. Transport container for stacked goods according to claim 5, wherein said carrying element (22) is formed as a section frame open at the top.

7. Transport container for stacked goods according to claim 5, wherein said carrier element (22) is formed as a flat trough, and said storage means comprises a storage tub positionable in said flat trough.

8. Transport container for stacked goods according to claim 5, wherein swivel brackets (24) are pivotally mounted on said corner posts adjacent the opening closed by said closing flap (9) with said swivel brackets being displaceable between a locking position extending into the path of said carrying element and a released position pivoted upwardly from the locking position and secured within a recess formed by said corner post (4).

9. Transport container for stacked goods, as set forth in claim 1, wherein a loading gear (27) engageable within said openings (26) for lifting said transport container.

* * * * *